US005598604A

United States Patent [19]

Ho

[11] Patent Number: 5,598,604

[45] Date of Patent: Feb. 4, 1997

[54] PENCIL-SHAPED ERASER

[76] Inventor: Kun-Chuan Ho, 58 Chung-Chen S. Rd., Yung-Kang City Tainan Shien, Taiwan

[21] Appl. No.: 436,847

[22] Filed: May 8, 1995

[51] Int. Cl.[6] ..... B43K 21/12; B43K 21/18; B43K 21/22

[52] U.S. Cl. ..... 15/433; 15/425; 226/127; 401/93

[58] Field of Search ..... 15/105.51, 425, 15/424, 426, 427, 428, 429, 430, 431, 432, 433, 434, 3, 53; 401/86, 93, 94, 67, 53, 82, 55, 65, 80; 226/127, 128, 129

[56] References Cited

U.S. PATENT DOCUMENTS

| | | | |
|---|---|---|---|
| 213,884 | 4/1879 | Faber | 401/93 |
| 699,743 | 5/1902 | Brownell | 15/432 |
| 1,248,988 | 12/1917 | Antler | 15/432 |
| 2,181,202 | 11/1939 | Prair | 401/93 |
| 2,535,823 | 12/1950 | Benschoten | 15/430 |
| 2,785,654 | 3/1957 | Lundberg, Sr. et al. | 401/93 |
| 4,856,693 | 8/1989 | Kageyama et al. | 15/433 |
| 4,979,254 | 12/1990 | Noujock | 15/433 |
| 5,362,166 | 11/1994 | Yamamoto et al. | 15/433 |

FOREIGN PATENT DOCUMENTS

| | | | |
|---|---|---|---|
| 12618 | 10/1910 | France | 401/93 |
| 845662 | 8/1939 | France | 401/93 |
| 195681 | 2/1938 | Switzerland | 401/93 |
| 413654 | 12/1966 | Switzerland | 401/93 |

*Primary Examiner*—Gary K. Graham

[57] ABSTRACT

A pencil-shaped eraser comprising an elongate tube for placing a bar eraser therein, a sleeve to fit around a lower portion of the tube movably, the lower portion of the tube having a plurality of claws divided by slots and movable inward, the claws respectively having a larger diameter constricting section and a smaller diameter loosening section, the sleeve having a hollow passageway consisting of a distal smaller diameter section and a proximal larger diameter section, the distal constricting section constricting the constricting section of the tube so that the claws may be compressed inward to constrict a bar eraser a little protruding out of the claws.

4 Claims, 4 Drawing Sheets

PENCIL-SHAPED ERASER

BACKGROUND OF THE INVENTION

This invention concerns a pencil-shaped eraser, particularly one simple structured, having an elongate bar eraser for use.

A conventional block eraser shown in FIG. 1 generally has a block-shaped eraser body 1, and a paper cover wrapping around the eraser body 1, having been used for years and years, and still being widely in use nowadays. Another pencil-shaped eraser has an elongate bar eraser wrapped with paper and the paper is gradually ripped off the bar eraser as the eraser is consumed. Another eraser is constructed as a pencil eraser, having an elongate bar eraser automatically protruding out for use.

These three kinds of erasers respectively have advantages and disadvantages from the points of cost and use.

SUMMARY OF THE INVENTION

This invention is a pencil-shaped eraser with a simple structure of few components and is easy to handle.

A main feature of this invention is an elongate tube for placing therein an elongate eraser, and a sleeve to move forward around a lower portion of the tube to constrict or loosen claws divided by slots provided in lower portion so that the elongate eraser may be secured or loosened for being pulled gradually out of the tube for use.

DETAILED DESCRIPTION OF THE INVENTION

Figure 1:
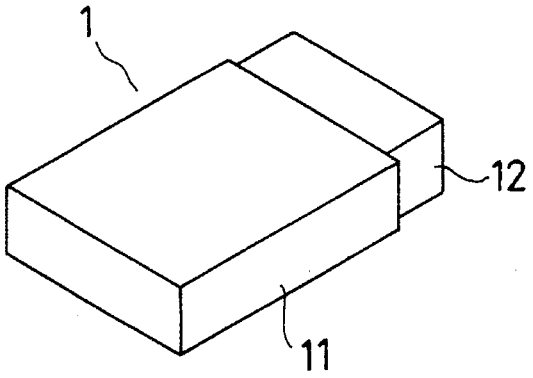
FIG. 1 (PRIOR ART)
FIG. 1 is a perspective view of a traditional eraser.
Figure 2:
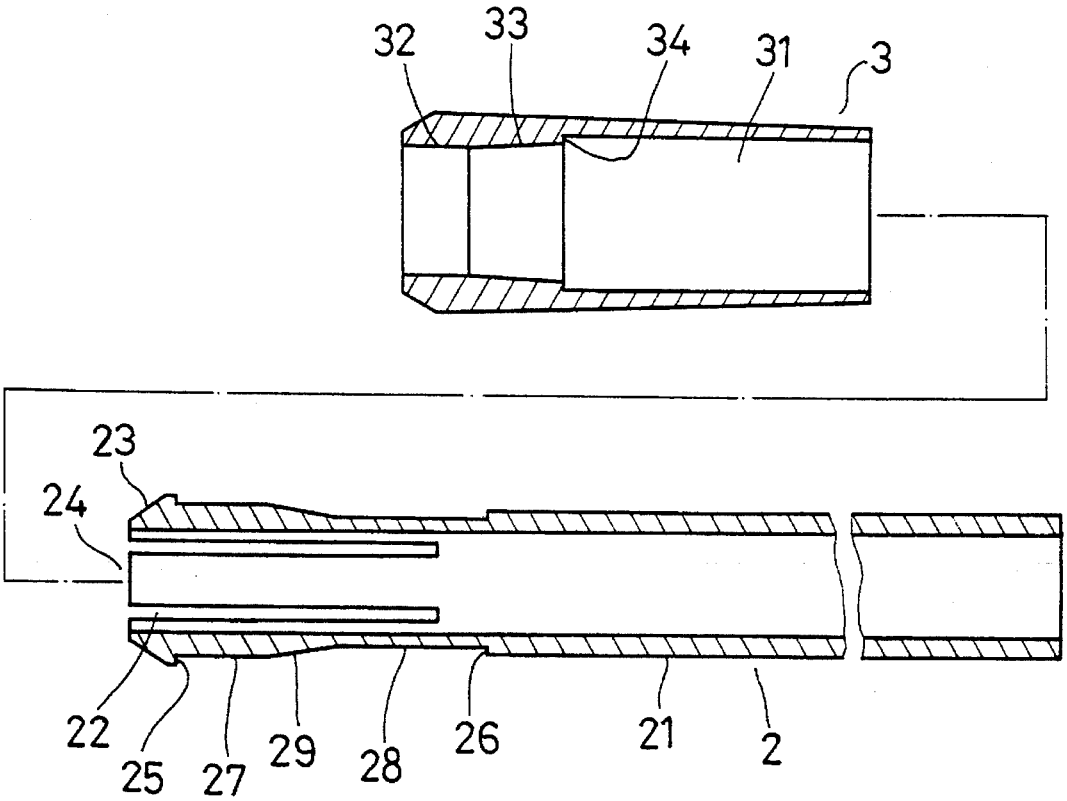
FIG. 2 is an exploded side view of a pencil-shaped eraser of the present invention.

A pencil-shaped eraser in the present invention, as shown in FIG. 2, comprises an elongate tube 2 and a sleeve 3 as components combined together.

Figure 3:
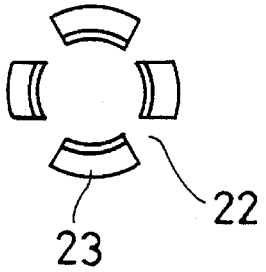
FIG. 3 is a front view of a tube of the pencil-shaped eraser of the present invention.

The elongate tube 2 has a through hollow passageway, an upper grip portion 21, a lower portion including a plurality of lengthwise collet claws 23 divided by the same number of lengthwise slots 22 equidistantly, as shown in FIG. 3. The collet claws 23 have respectively a first annular stop edge 25 near the lower end defining an opening 24, and a second annular stop edge 26 at an abutting spot of the lower portion and the upper grip portion 21. The outer surface between the first annular stop edge 25 and the second annular stop edge 26 are provided with a distal constricting section 27, and intermediate tapered section 29 and a proximal loosening section 28 in series. The distal constricting section 27 has a largest outer diameter, the intermediate tapered section has a smaller outer diameter than the distal constricting section 27 but larger than the proximal loosening section 28. And the first and the second annular stop edges have a larger diameter than the distal constricting section 27.

The sleeve 3 has a hollow passageway, which is divided into a proximal section 31 in an upper portion having a slightly larger diameter than the outer diameter of the upper grip portion 21 of the tube 2, a distal constricting section 32 having a slightly smaller inner diameter than the outer diameter of the constricting section 27 of the tube 2, and an intermediate tapered section 33 between the proximal section 31 and the distal constricting section 32, and a shoulder 34 defined by the two sections 31 and 33.

Figure 4:
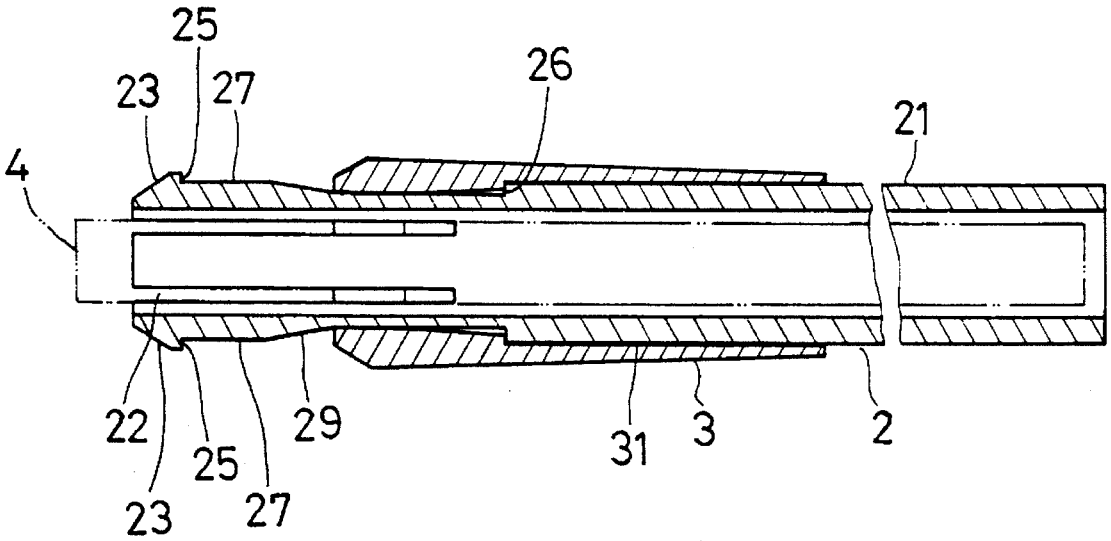
FIG. 4 is a side cross-sectional view of the pencil-shaped eraser of the present invention, showing it in a loosened position.

In using, referring to FIG. 4, the sleeve 3 is pushed to fit around the lower portion and a part of the upper portion of the tube 2, compressing the collet claws 23 inside because of the slots 22. The sleeve 3 can be moved forward and backward around the tube, letting the loosening section 31 surrounding the second stop edge 26 and the lower part of the upper portion 21 of the tube 2, with the shoulder 34 stopped by the second stop edge 26. In this position, the collet claws 23 are not constricted so that a bar eraser 4 may be pushed in the tube 2 through the lower opening 24, and moved therein to let the lower end of the eraser 4 protrude a little out of the opening 24 of the tube.

Figure 5:
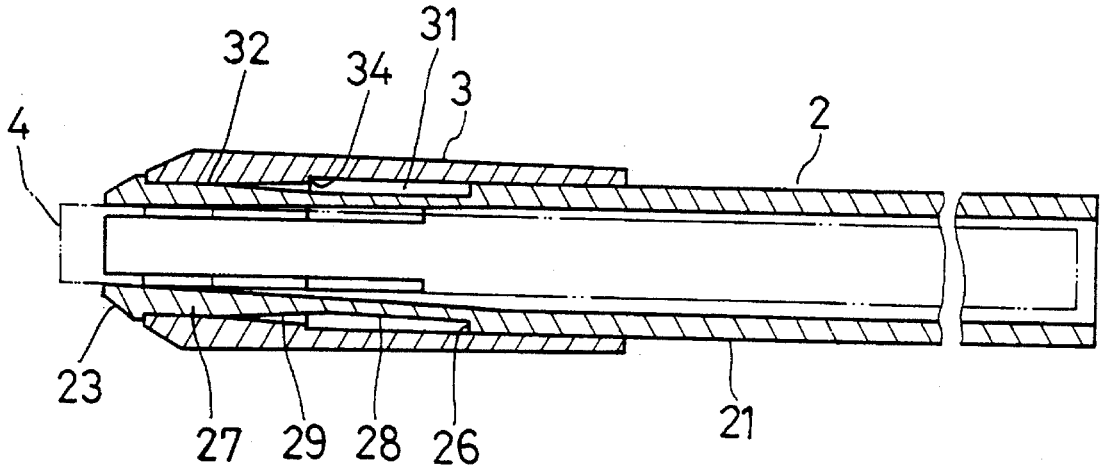
FIG. 5 is a side cross-sectional view of the pencil-shaped eraser of the present invention, showing it constricting a bar eraser.

When the bar eraser 4 is moved to stop at the position shown in FIG. 5, with the lower end of the bar eraser 4 protruding a little out of the opening 24 of the tue 2, the sleeve 3 is moved forward towards the lower end of the tube 2, letting the constricting section 32 fit around the constricting section 27 of the tube 7 and constricting tightly the collet claws 23, which are then pressed inwardly to constrict and immobilize the bar eraser 4. At the same time, the lower end of the sleeve 3 is stopped by the first annular stop edge 25, and prevented from sliding of the tube 2. The bar eraser 4 is then secured and can be used for erasing.

Figure 6:
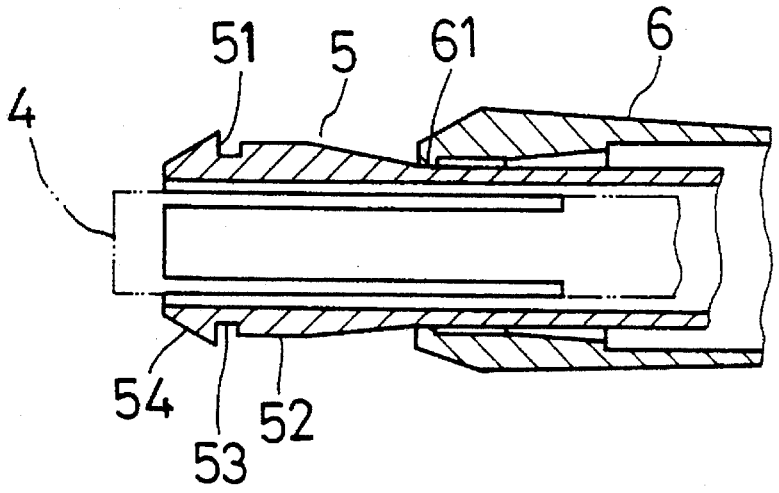
FIG. 6 is a partial cross-sectional view showing the relative positions of a tube and a sleeve of the pencil-shaped eraser in the present invention.

A second embodiment of the pencil-shaped eraser of the present invention, as shown in FIG. 6, comprises a tube 5 having the same structure as the tube 2 in the first embodiment except for a third stop groove 53 provided between a first stop edge 51 and a constricting section 52 and an inner end edge 61 provided at the lower end of a sleeve 6 and having an inner diameter smaller than the outer diameter of the constricting section 52. The inner end edge 61 can engage the third stop groove 53 when the constricting end edge 61 of the sleeve 6 is moved on the constricting section 52 of the tube 5, preventing the collet claws 54 from opening outward in using the bar eraser 4.

Figure 7:
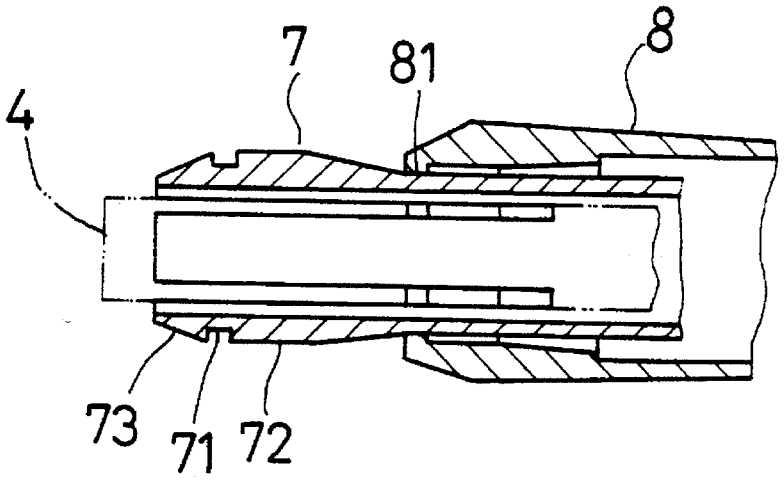
FIG. 7 is a partial cross-sectional view showing the relative positions of the tube and the sleeve of the pencil-shaped eraser in the present invention.

A third embodiment of the pencil-shaped eraser in the present invention, as shown in FIG. 7, comprises a first stop groove 71 formed instead of the annular stop edge 25 of the first embodiment and an inner annular end edge 81 provided at the lower end of a sleeve 8 and having a smaller inner diameter than the outer diameter of a constricting section 72 of the tube 7. The constricting edge 81 can engage the first stop groove 71 when the sleeve 8 is moved to surround the constricting section 71 of the tube 7, preventing the sleeve 8 from sliding off the tube 7. In addition, collet claws 73 of the tube 7 can be prevented from opening outward to loosen the eraser 4 during use.

What is claimed is:

1. An eraser holder comprising:

a) an elongated tubular member having a central passageway extending along the length of the tubular member to accommodate an eraser therein, a first end portion, a second end portion and an annular stop surface extending radially outwardly from the second end portion;

b) a plurality of collet claws formed on the second end portion, adjacent collet claws being separated by slots, distal ends of the collet claws forming an end opening configured to accommodate an eraser, such that the collet claws are movable between loosened positions wherein an eraser may be slid into and out of the end opening and constricted gripping positions wherein an eraser in the end opening is fixedly attached to the eraser holder, the collet claws forming an annular, elongated exterior constricting surface adjacent to the end opening having a diameter $d_1$ in the loosened positions, an annular, elongated exterior loosening surface having a diameter $d_2$ less than $d_1$ in the loosened positions and an annular, tapered exterior surface connecting the constricting surface and the loosening surface;

c) a sleeve slidably located on the elongated tubular member, the sleeve having an annular, inner constricting surface having a diameter $d_3$ less than $d_1$ and an inner, annular shoulder, the sleeve slidably movable on the elongated tubular member in first and second directions between a loosened position wherein the inner constricting surface is out of contact with the exterior constricting surface, the collet claws are in their loosened positions and the annular shoulder is in contact with the annular stop surface to limit sliding movement in the first direction and a gripping position wherein the inner constricting surface is in contact with the outer constricting surface so as to move the collet claws to their gripping positions; and, d) stop means on the collet claws and sleeve to prevent sliding movement between the sleeve and the elongated member in the first and second direction when the sleeve is in the gripping position.

2. The eraser holder of claim 1 wherein the stop means comprises:

a) a groove formed in the exterior constricting surface of each collet claw; and b) a protruding inner edge on the sleeve located such that the protruding inner edge engages the grooves when the sleeve is in the gripping position.

3. The eraser holder of claim 2 further comprising:

a) a second stop surface extending outwardly from each collet claw; and b) a third stop surface on the sleeve and located so as to contact the second stop surface when the sleeve is in the gripping position.

4. The eraser holder of claim 1 further comprising:

a) a second stop surface extending outwardly from each collet claw; and b) a third stop surface on the sleeve and located so as to contact the second stop surface when the sleeve is in the gripping position.

* * * * *